US007516953B2

(12) United States Patent
Lee

(10) Patent No.: US 7,516,953 B2
(45) Date of Patent: Apr. 14, 2009

(54) DOCUMENT FEEDER

(75) Inventor: Hsin-Wen Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 49 days.

(21) Appl. No.: 11/755,158

(22) Filed: May 30, 2007

(65) Prior Publication Data

US 2008/0169598 A1 Jul. 17, 2008

(30) Foreign Application Priority Data

Jan. 11, 2007 (TW) ..... 96101027 A

(51) Int. Cl.
*B65H 3/06* (2006.01)

(52) U.S. Cl. ..... 271/117; 271/118

(58) Field of Classification Search ..... 271/117, 271/118, 241, 124
See application file for complete search history.

(56) References Cited

U.S. PATENT DOCUMENTS 6,086,062 A * 7/2000 Nakamura et al. ..... 271/121
2005/0035524 A1 * 2/2005 Fukumura et al. ..... 271/4.1

* cited by examiner

*Primary Examiner*—Patrick H Mackey
*Assistant Examiner*—Ernesto Suarez
(74) *Attorney, Agent, or Firm*—Kirton & McConkie; Evan R. Witt

(57) ABSTRACT

A document feeder includes a casing, a sheet pick-up module, a stopper and a swing lever. The casing includes a sheet feeding channel therein. The sheet pick-up module is pivotally mounted above the sheet feeding channel, and movable between a sheet feeding position and a standby position. The stopper is disposed under the sheet feeding channel. The swing lever includes a first end part is pressed down by the sheet pick-up module and a second end part is pressed down by the stopper. When the sheet pick-up module is switched from the sheet feeding position to the standby position, the sheet pick-up module depresses the first end part of the swing lever, so that the stopper is raised by the second end part of the swing lever to be protruded to the sheet feeding channel.

8 Claims, 5 Drawing Sheets

DOCUMENT FEEDER

FIELD OF THE INVENTION

The present invention relates to a document feeder, and more particularly to a document feeder having a stopper.

BACKGROUND OF THE INVENTION

Conventionally, for scanning several paper sheets, the paper sheets should be manually placed on a scanning platform of the image scanner one by one. This means of manually feeding the paper sheets is time-consuming and laboring. Nowadays, the image scanner usually has a document feeder for successively and continuously feeding many paper sheets. As known, a conventional document feeder has a sheet pick-up module arranged in the sheet feeding channel for automatically feeding the paper sheets one by one at a time.

When the paper sheets are placed on the sheet feeding channel to be scanned, the front edges are usually inserted into the sheet feeding channel and thus several paper sheets may be simultaneously fed by the sheet pick-up module. For assuring that a stack of paper sheets are precisely positioned within the sheet feeding channel, the document feeder further has a stopper under or above the sheet pick-up module. When the stack of paper sheets enters the sheet feeding channel, the stopper is sustained against the front edges of the stack such that the paper sheets are positioned under the sheet pick-up module. Once the paper sheets are stopped by the stopper, the user may feel that the paper sheets are placed in position. When the sheet pick-up module performs the sheet pick-up operation, the stopper is shifted such that the paper sheets are smoothly transported through the sheet feeding channel.

FIG. 1A is a schematic perspective view illustrating the sheet pick-up module and the stopper of a conventional document feeder. This document feeder is for example disclosed in U.S. Pat. No. 6,792,241, and the contents of which are hereby incorporated by reference. The stopper 12 is pivotal and disposed under the sheet pick-up module 11. The sheet pick-up module 11 comprises a sustaining portion 111. Correspondingly, the stopper 12 comprises a tilt portion 121 and a sheet stop portion 122. When the sheet pick-up module 11 is lifted to a standby position, the sheet stop portion 122 is rotated to an upright position so as to be sustained against the front edges of the stack of paper sheets. Whereas, during the sheet pick-up module 11 is lowered to a sheet pick-up position, the sustaining portion 111 is also lowered down to touch the tilt portion 121 of the stopper 12. In response to the external force generated from rotation of the sheet pick-up module 11, the sheet stop portion 122 is rotated under the sheet feeding channel. Under this circumstance, the paper sheets can be smoothly transported through the sheet feeding channel without being stopped by the stopper 12.

Please refer to FIG. 1B, which is a schematic cross-section view illustrating relative locations of the sheet pick-up module and the stopper of the conventional document feeder. However, the stopper 12 of the conventional document feeder still has some drawbacks. For example, when a stack of paper sheets are positioned within the sheet feeding channel, if the an external force exerted on the paper sheets is very large or if the front edges of these paper sheets are not aligned with each other, the top paper sheets St may suppress the tilt portion 121 of the stopper 12. Under this circumstance, the sheet stop portion 122 is rotated under the sheet feeding channel before the sheet pick-up operation is done, so that the function of the stopping the paper sheets is lost.

In views of the above-described disadvantages resulted from the prior art, the applicant keeps on carving unflaggingly to develop an improved document feeder according to the present invention through wholehearted experience and research.

SUMMARY OF THE INVENTION

It is an object of the present invention to provide a document feeder, in which a stopper is made upright to stop the paper sheets with the assistance of a guiding slot and a swing lever when the sheet pick-up module is lifted to the standby position.

Another object of the present invention provides a document feeder for preventing rotation of the stopper when the stopper is suppressed by the paper sheets.

In accordance with an aspect of the present invention, there is provided a document feeder. The document feeder includes a casing, a sheet pick-up module, a stopper and a swing lever. The casing includes a sheet feeding channel therein. The sheet pick-up module is pivotally mounted above the sheet feeding channel, and includes a sheet pick-up roller and a sheet separation roller. The stopper is disposed under the sheet feeding channel and adjacent to the sheet pick-up roller. The swing lever is pivotally mounted under the sheet feeding channel and adjacent to the sheet separation roller, and includes a first end part and a second end part, wherein the first end part is pressed down by the sheet pick-up module and the second end part is pressed down by the stopper.

In an embodiment, the sheet pick-up module further comprises a wing structure for depressing a tip of the first end part of the swing lever.

Preferably, the second end part of the swing lever is an elastic element.

Preferably, the second end part of the swing lever is an elastic sheet.

Preferably, the second end part of the swing lever is a linear spring.

In an embodiment, the document feeder further includes a guiding slot under the sheet feeding channel for guiding the stopper to move therein.

In accordance with another aspect of the present invention, there is provided a document feeder. The document feeder includes a casing, a sheet pick-up module, a stopper and a swing lever. The casing includes a sheet feeding channel therein. The sheet pick-up module is pivotally mounted above the sheet feeding channel, and movable between a sheet feeding position and a standby position. The stopper is disposed under the sheet feeding channel. The swing lever includes a first end part pressed down by the sheet pick-up module and a second end part pressed down by the stopper. When the sheet pick-up module is switched from the sheet feeding position to the standby position, the sheet pick-up module depresses the first end part of the swing lever, so that the stopper is raised by the second end part of the swing lever to be protruded to the sheet feeding channel.

In an embodiment, the stopper is sunk under the sheet feeding channel when the sheet pick-up module is switched from the standby position to the sheet feeding position.

In an embodiment, the sheet pick-up module further comprises a wing structure for depressing a tip of the first end part of the swing lever.

In an embodiment, the document feeder further includes a guiding slot under the sheet feeding channel for guiding the stopper to move therein.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For overcoming the above described drawbacks, the present invention relates to a document feeder. Hereinafter, an embodiment of maintaining the stopper in an upright state to implement the function of stopping the paper sheets with the assistance of a guiding slot and a swing lever will be illustrated as follows.

Figure 1A:
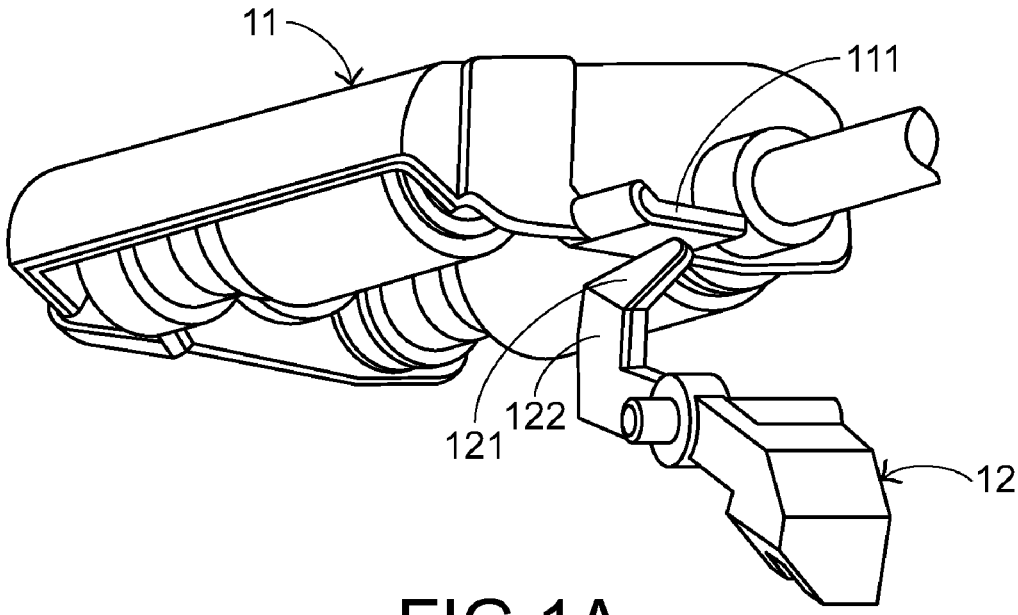
FIG.1A PRIOR ART
FIG. 1A is a schematic perspective view illustrating the sheet pick-up module and the stopper of a conventional document feeder.
Figure 1B:
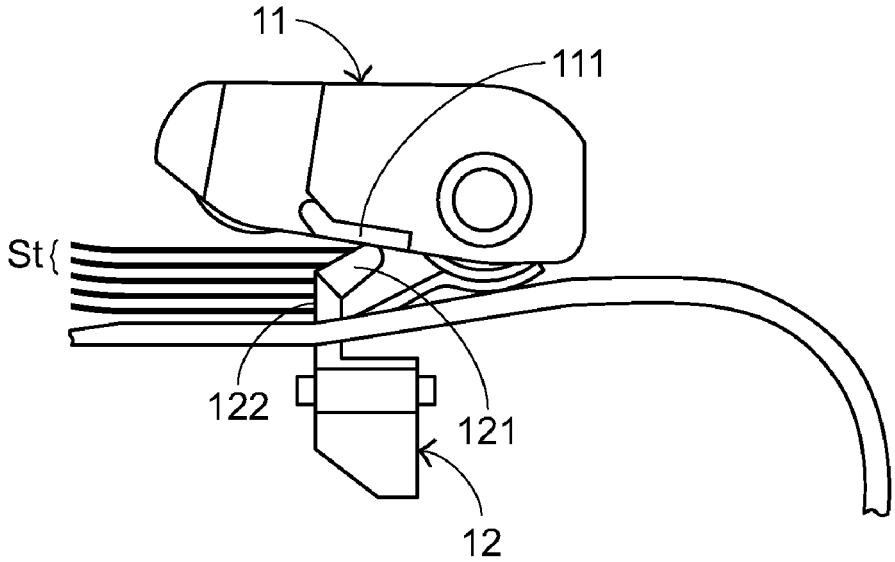
FIG.1B PRIOR ART
FIG. 1B is a schematic cross-sectional view illustrating relative locations of the sheet pick-up module and the stopper of a conventional document feeder.
Figure 2:
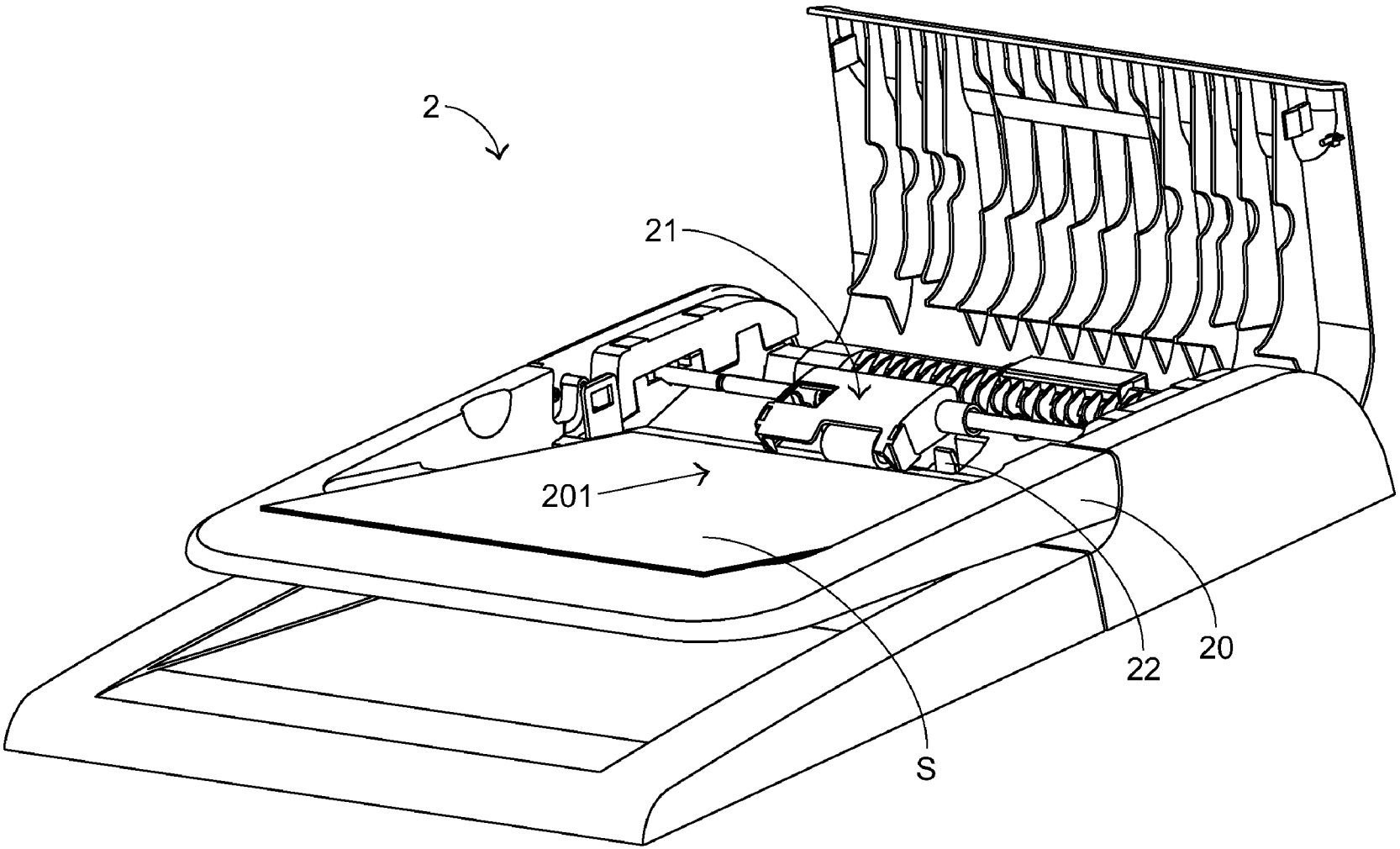
FIG. 2 is a schematic perspective view of a document feeder according to a preferred embodiment of the present invention.
Figure 3:
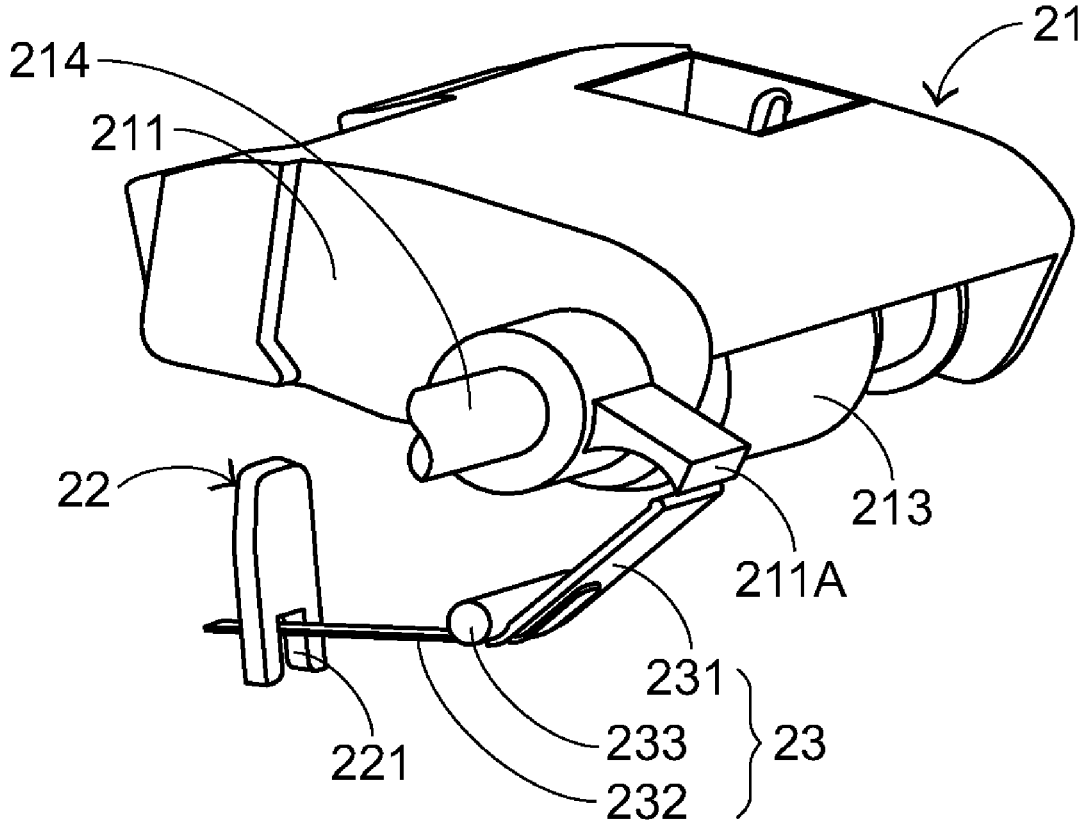
FIG. 3 is a schematic perspective view illustrating relative locations between the sheet pick-up module, the stopper and the swing lever of the document feeder.
Figure 4A:
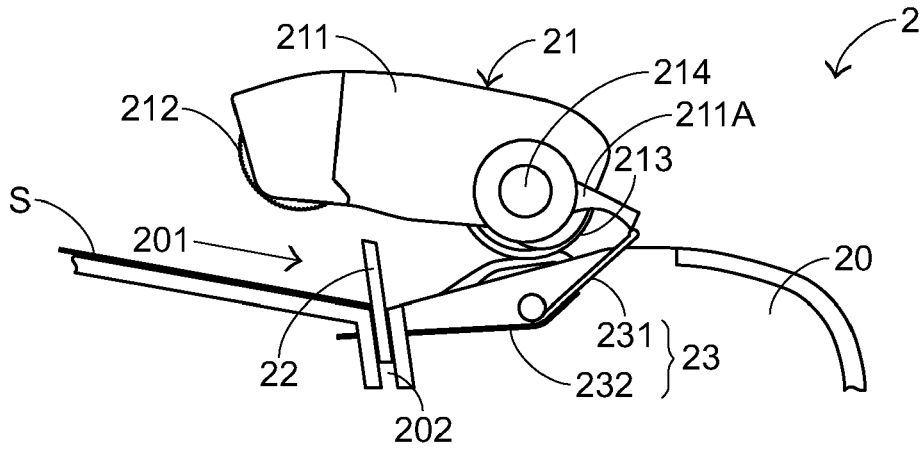
FIG. 4A is a schematic cross-sectional view illustrating that the stopper is lifted to protrude to the sheet feeding channel when the sheet pick-up module is in the standby position.

Referring to FIG. 2, a schematic perspective view of a document feeder according to a preferred embodiment of the present invention is illustrated. The document feeder 2 includes a casing 20, a sheet pick-up module 21, a stopper 22 and a swing lever 23 (as is shown in FIG. 3). Within the casing 20, a sheet feeding channel 201 is provided for placing therein the paper sheets S to be transported therethrough. The sheet pick-up module 21 is pivotally mounted above the sheet feeding channel 201 for feeding the paper sheets S into the document feeder 2 through the sheet feeding channel 201. The sheet pick-up module 21 includes a frame 211, a sheet pick-up roller 212, a sheet separation roller 213 (as is shown in FIG. 4A), and a driving shaft 214. The driving shaft 214 is penetrated through the frame 211 and sheathed by the sheet separation roller 213. The driving shaft 214 is coupled to an actuating mechanism (not shown) within the document feeder 2 and is driven by the actuating mechanism to rotate. Before or after the sheet pick-up operation has been done, the sheet pick-up module 21 is driven by the actuating mechanism to be lifted to a standby position. For a purpose of feeding the paper sheets, the driving shaft 214 is driven to rotate in the opposite direction such that the sheet pick-up module 21 is lowered to the sheet feeding position. Meanwhile, the sheet pick-up roller 212 comes into contact with the top surface of the paper sheets S and transports the paper sheets S forwardly.

In accordance with a feature of the present invention, the sheet pick-up module 21, the stopper 22 and the swing lever 23 of the document feeder 2 are cooperated to activate the function of stopping the paper sheets. Please refer to FIG. 3, which is a schematic perspective view illustrating relative locations between the sheet pick-up module 21, the stopper 22 and the swing lever 23. The swing lever 23 comprises a first end part 231, a second end part 232 and a pivotal part 233. The pivotal part 233 is arranged between the first end part 231 and the second end part 232. Since the pivotal part 233 serves as a fulcrum, the first end part 231 and the second end part 232 may be seesawed. Please refer to FIG. 3 again. The sheet pick-up roller 212 and the sheet separation roller 213 are located at the front end and the rear end of the sheet pick-up module 21, respectively. A wing structure 211A is protruded from a lateral side at the rear end of the frame 211 of the sheet pick-up module 21. In a case that the first end part 231 is uplifted, the wing structure 211A at the rear end of the sheet pick-up module 21 will depress the tip of the first end part 231 of the swing lever 23. Correspondingly, the second end part 232 of the swing lever 23 is swung upwardly to raise the stopper 22. Consequently, the paper sheets S are hindered from being transported through the sheet feeding channel 201. When the sheet pick-up module 21 is lowered to the sheet feeding position, the stopper 22 is moved downwardly and sunk under the sheet feeding channel 201, so that the paper sheets S may enter the sheet feeding channel 201 without being stopped by the stopper 22. In addition, the stopper 22 further includes a positioning structure at the lower end thereof. An exemplary positioning structure is a notch 221. The tip of the second end part 232 of the swing lever 23 is received in the notch 221 of the stopper 22.

Hereinafter, a process of performing the sheet pick-up operation by the sheet pick-up module 21, the stopper 22 and the swing lever 23 of the document feeder 2 will be illustrated with reference to FIGS. 4A~4E.

First of all, as shown in FIG. 4A, the sheet pick-up module 21 is pivotally mounted above the sheet feeding channel 201 for feeding the paper sheets S into the document feeder 2 through the sheet feeding channel 201. The sheet pick-up module 21 includes a frame 211, a sheet pick-up roller 212, a sheet separation roller 213 and a driving shaft 214. The stopper 22 is disposed under the sheet feeding channel 201 and beside the sheet pick-up roller 212. The swing lever 23 is pivotally mounted under the sheet feeding channel 201 and beside the sheet separation roller 213. Moreover, a guiding slot 202 is arranged under the sheet feeding channel 201 for accommodating the stopper 22 and guiding the stopper 22 to move upwardly or downwardly therein.

Please refer to FIG. 4A again. Before or after the sheet pick-up operation of the document feeder 2 has been done, the sheet pick-up module 21 is driven by the actuating mechanism to be lifted to a standby position. During the sheet pick-up module 21 is lifted to the standby position, the wing structure 211A at the rear end of the sheet pick-up module 21 will depress the tip of the first end part 231 of the swing lever 23. Correspondingly, the second end part 232 of the swing lever 23 is swung upwardly to raise the stopper 22. Under this circumstance, the stopper 22 is moved upwardly along the guiding slot 202 and partially protruded from the guiding slot 202, so that the paper sheets S are hindered from being transported through the sheet feeding channel 201. As shown in FIG. 4A, the upper portion of the stopper 22 is made upright to stop the paper sheets S, and the lower portion of the stopper 22 is clamped by the guiding slot 202.

Please refer to FIG. 4A again. When the paper sheets S is positioned in the sheet feeding channel 201 and the frond edges of the paper sheets S are sustained against the stopper 22, the stopper 22 is still made upright to stop the paper sheets S because the stopper 22 is clamped by the guiding slot 202 and raised by the swing lever 23.

Figure 4B:
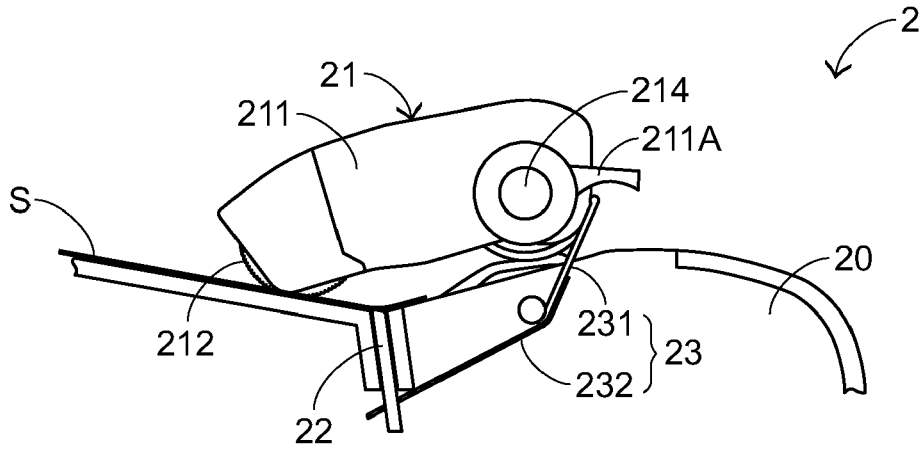
FIG. 4B is a schematic cross-sectional view illustrating that the stopper is sunk under the sheet feeding channel when the sheet pick-up module is in the sheet feeding position.

As shown in FIG. 4B, during the sheet pick-up operation of the document feeder 2 is performed, the sheet pick-up module 21 is lowered to the sheet feeding position by the actuating mechanism in order to implement a sheet feeding operation. The sheet pick-up roller 212 is rotated on the top surface of the paper sheets S. When the sheet pick-up module 21 is lowered to the sheet feeding position, the wing structure 211A at the rear end of the sheet pick-up module 21 will be raised and no longer depress the first end part 231 of the swing lever 23. Correspondingly, the second end part 232 of the swing lever 23 is swung downwardly due to the gravity force of the stopper 22 applied thereon. Under this circumstance, the stopper 22 is moved downwardly along the guiding slot 202 and fully sunk under the sheet feeding channel 201, so that the paper sheets S may enter the sheet feeding channel 201 without being stopped by the stopper 22.

Figure 4C:
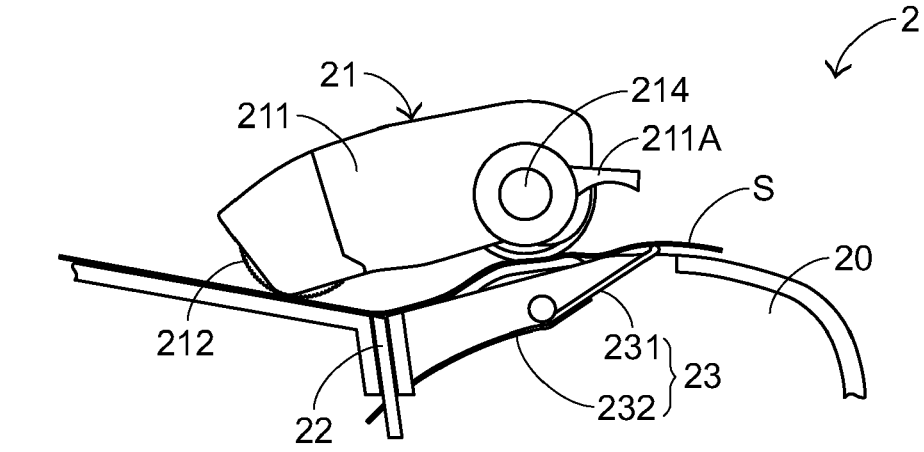
FIG. 4C is a schematic cross-sectional view illustrating that the first end part of the swing lever is depressed by the paper sheet and the second end part of the swing lever is deformed.

Next, as shown in FIG. 4C, the second end part 232 of the swing lever 23 is made of an elastic element, for example an elastic sheet or a linear spring. Since the second end part 232 of the swing lever 23 is elastic and flexible, it is difficult to swing upwardly the second end part 232 of the swing lever 23 to raise the stopper 22 during the paper sheet S comes into contact with the first end part 231 of the swing lever 23. As a consequence, the paper sheet S will not be scraped by the stopper 22. When the paper sheet S is transported to enter the sheet feeding channel 201, the paper sheet S comes into contact with the first end part 231 of the swing lever 23 and the first end part 231 of the swing lever 23 is depressed by the paper sheet S. Since the stopper 22 is also depressed by the paper sheet S at this moment, the stopper 22 is still sunk under the sheet feeding channel 201. Meanwhile, due to elasticity and flexibility, the second end part 232 of the swing lever 23 is deformed and the stopper 22 fails to be raised by the second end part 232. As a consequence, the possibility of scraping the paper sheet S by the sunken stopper 22 is largely reduced.

Figure 4D:
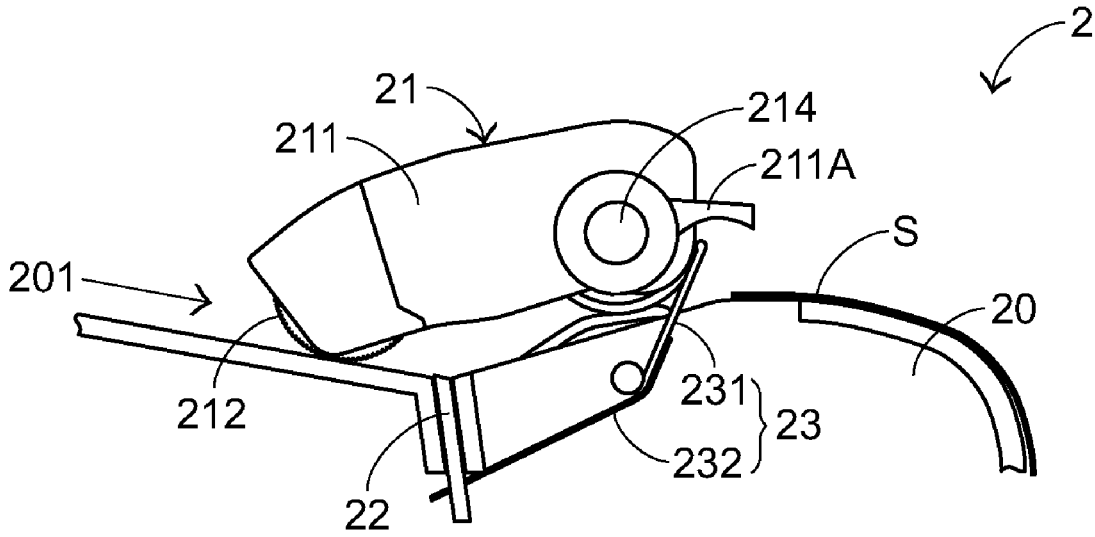
FIG. 4D is a schematic cross-sectional view illustrating that the paper sheet is transported across the first end part of the swing lever and the second end part of the swing lever is returned to its original state.

Please refer to FIG. 4D. After the paper sheet S is fully transported across the first end part 231 of the swing lever 23, the stopper 22 and the first end part 231 of the swing lever 23 are not depressed by the paper sheet S. Meanwhile, the first end part 231 of the swing lever 23 is swung upwardly and the deformed second end part 232 of the swing lever 23 is returned to its original state.

Figure 4E:
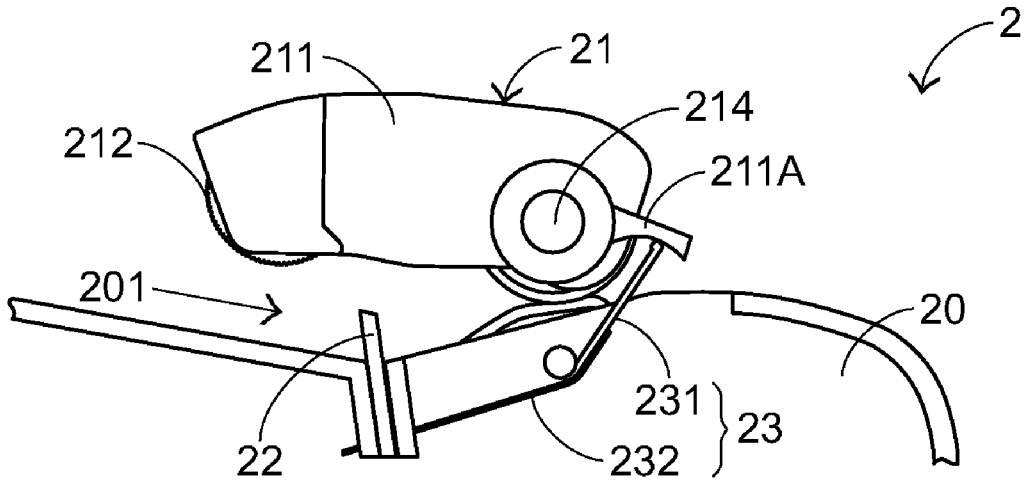
FIG. 4E is a schematic cross-sectional view illustrating that the stopper is lifted to protrude to the sheet feeding channel when the sheet pick-up module is switched to the standby position.

Please refer to FIG. 4E. After the sheet feeding operation of the document feeder 2 is finished, the sheet pick-up module 21 is lifted to the standby position by the actuating mechanism. Meanwhile, the wing structure 211A at the rear end of the sheet pick-up module 21 will depress the tip of the first end part 231 of the swing lever 23. Correspondingly, the second end part 232 of the swing lever 23 is swung upwardly to raise the stopper 22. Under this circumstance, the stopper 22 is partially protruded from the guiding slot 202, so that the paper sheet S is hindered from being transported through the sheet feeding channel 201.

As previously described, since the stopper of the conventional document feeder is rotatable, the function of the stopping the paper sheets is possibly lost if the stopper is suppressed by the paper sheets. According to the present invention, before the sheet pick-up operation of the document feeder is done, the stopper is made upright to stop the paper sheets with the assistance of the guiding slot and the swing lever.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A document feeder comprising:

a casing including a sheet feeding channel therein;

a sheet pick-up arm pivotally mounted above said sheet feeding channel, and including a sheet pick-up roller, a sheet separation roller, and a wing structure protruding from a lateral side of said sheet pick-up arm;

a stopper disposed under said sheet feeding channel and adjacent to said sheet pick-up roller; and a swing lever pivotally mounted under said sheet feeding channel and adjacent to said sheet separation roller, and including a first end part and a second end part, wherein a tip of said first end part is pressed down by said wing structure of said sheet pick-up arm and said second end part is pressed down by said stopper.

2. The document feeder according to claim 1 wherein said second end part of said swing lever is an elastic element.

3. The document feeder according to claim 2 wherein said second end part of said swing lever is an elastic sheet.

4. The document feeder according to claim 2 wherein said second end part of said swing lever is a linear spring.

5. The document feeder according to claim 1 further including a guiding slot under said sheet feeding channel for guiding said stopper to move therein.

6. A document feeder comprising:

a casing including a sheet feeding channel therein;

a sheet pick-up arm pivotally mounted above said sheet feeding channel, and movable between a sheet feeding position and a standby position;

a stopper disposed under said sheet feeding channel; and a swing lever including a first end part pressed down by said sheet pick-up arm, a second end part pressed down by said stopper, and a pivotal part arranged between said first end part and said second end part, wherein said sheet pick-up arm comprises a wing structure that depresses a tip of said first end part of said swing lever when said sheet pick-up arm is switched from said sheet feeding position to said standby position, so that said swing lever pivots about said pivotal part and causes said second end part to raise said stopper to be protruded into said sheet feeding channel.

7. The document feeder according to claim 6 wherein said stopper is sunk under said sheet feeding channel when said sheet pick-up arm is switched from said standby position to said sheet feeding position.

8. The document feeder according to claim 6 further including a guiding slot under said sheet feeding channel for guiding said stopper to move therein.

* * * * *